US005170550A

United States Patent [19]

Cox et al.

[11] Patent Number: 5,170,550

[45] Date of Patent: Dec. 15, 1992

[54] DOUBLE-WALLED CABINET STRUCTURE FOR AIR CONDITIONING EQUIPMENT

[75] Inventors: Jimmy L. Cox, Greenwood; John B. Greenfield; Kendall L. Ross, both of Fort Smith, all of Ark.

[73] Assignee: Rheem Manufacturing Company, New York, N.Y.

[21] Appl. No.: 662,358

[22] Filed: Feb. 28, 1991

[51] Int. Cl.[5] ..... B65D 90/02

[52] U.S. Cl. ..... 29/455.1; 29/525.1; 29/890,035; 29/897.3; 52/630; 52/631; 220/419; 220/425; 220/DIG. 5

[58] Field of Search ..... 29/890.03, 890.035, 29/897, 897.3, 897.31, 897.35, 455.1, 505, 521, 451, 525.1; 165/54, 56; 312/214; 220/416, 419, 425, DIG. 25; 52/630, 631, 811

[56] References Cited

U.S. PATENT DOCUMENTS

| | | | |
|---|---|---|---|
| 1,195,845 | 8/1916 | Neal . | |
| 1,768,584 | 7/1930 | Eaglesfield . | |
| 2,086,225 | 7/1937 | Hiereng | 113/116 |
| 2,324,710 | 7/1943 | Livar | 189/34 |
| 2,527,226 | 10/1950 | Levine | 126/114 |
| 2,683,927 | 7/1954 | Maronek | 29/521 |
| 2,731,167 | 1/1956 | Moore | 220/DIG. 25 |
| 3,409,976 | 11/1968 | Kesling | 29/476 |
| 3,757,559 | 9/1973 | Welsh | 72/379 |
| 3,875,633 | 4/1975 | Cornell | 29/897 |
| 3,911,554 | 10/1975 | Ford | 29/527.2 |
| 4,043,624 | 8/1977 | Lindenschmidt | 52/631 X |
| 4,628,661 | 12/1986 | St. Louis | 52/658 |
| 4,704,837 | 11/1987 | Menchetti et al. | 52/631 |
| 4,817,263 | 4/1989 | Donaldson et al. | 29/455.1 |

FOREIGN PATENT DOCUMENTS 9560 of 1905 United Kingdom ..... 220/DIG. 25

*Primary Examiner*—Joseph M. Gorski

*Attorney, Agent, or Firm*—Konneker & Bush

[57] ABSTRACT

The operating components of a forced air furnace are disposed within a double-walled cabinet structure having inner and outer metal walls which define therebetween an insulating air space that replaces the fibrous insulation normally adhered to the interior surface of furnace cabinetry. The illustrated cabinet structure representatively comprises a coil housing positioned atop a return housing. Each housing is formed from initially flat inner and outer sheet metal panels having rectangular configurations and various transverse projections thereon which permit the panels to be nested in a spaced apart, laterally facing relationship. Opposite end portions of the nested panels are then transversely bent in the same direction to form from the nested panels three interconnected sides of the housing, and the outer ends of the bent panel structure are secured together by elongated metal joining members extended across the resulting open fourth side of the housing. The transverse projections on the bent panel members automatically cooperate to hold them together and to maintain the insulating air space therebetween. To complete each housing a hollow, double-walled metal access panel is removably secured to the outer ends of the bent panels and extends across the open fourth side of the housing.

6 Claims, 3 Drawing Sheets

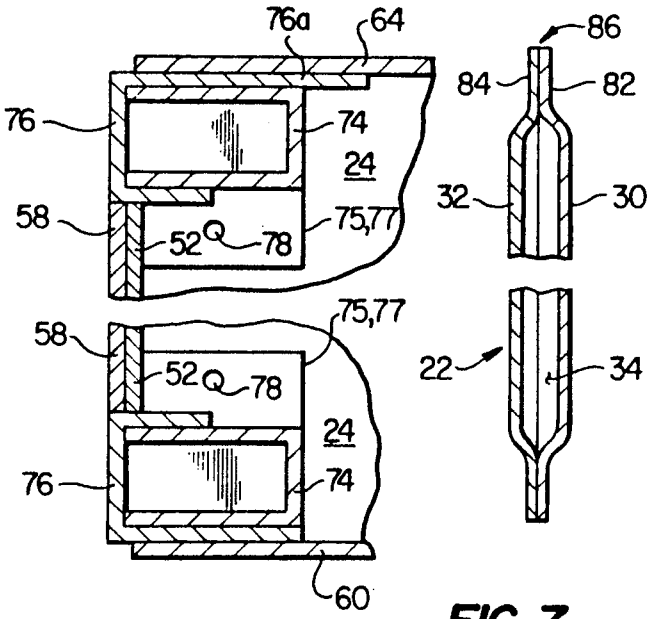
FIG. 7
FIG. 6
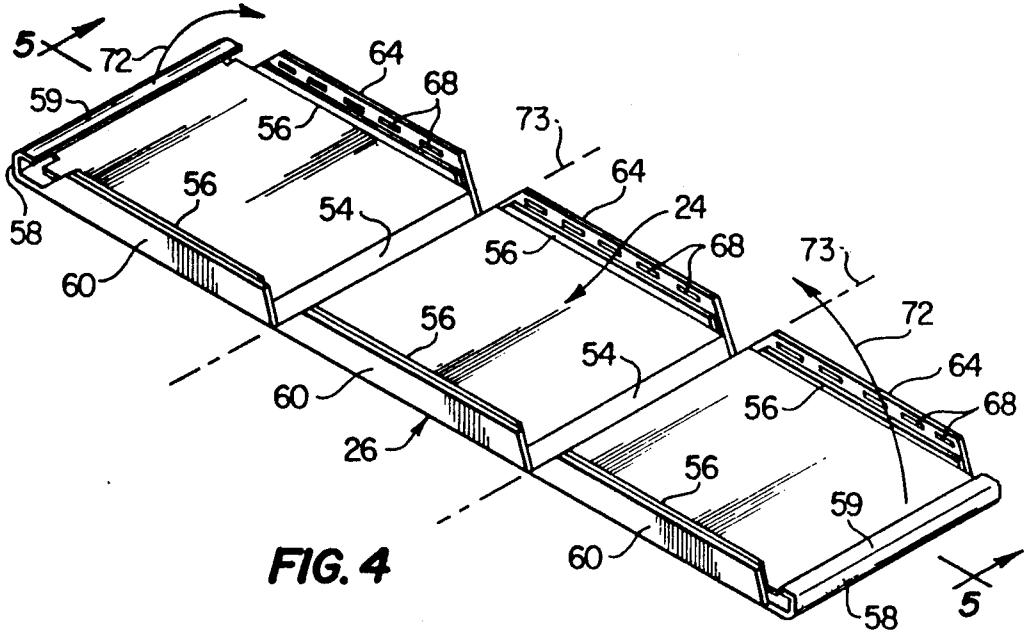
FIG. 4
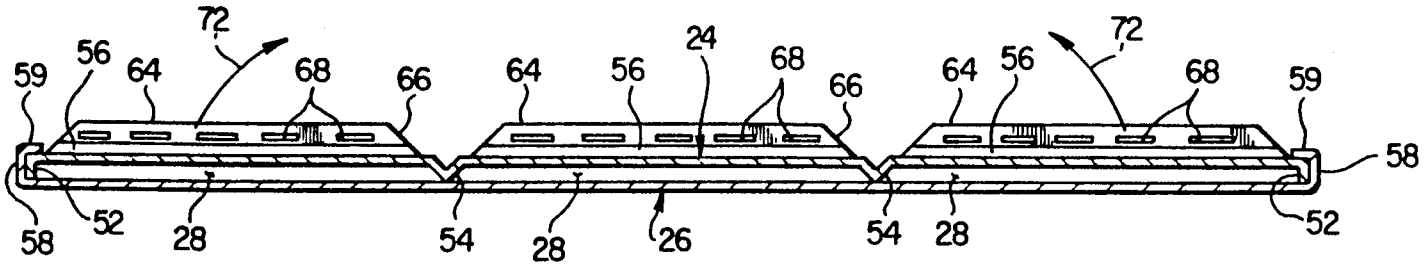
FIG. 5

DOUBLE-WALLED CABINET STRUCTURE FOR AIR CONDITIONING EQUIPMENT

BACKGROUND OF THE INVENTION

The present invention generally relates to air conditioning apparatus, and more particularly relates to housing or cabinetry structures in which the operating components of various types of air conditioning equipment, such as furnaces, air handlers and heat pumps, are disposed for air flow therethrough.

According to currently practiced assembly methods, the operating components of the above-mentioned and other types of air conditioning equipment are typically housed within a rectangularly cross-sectioned cabinet formed from a single layer outer sheet metal jacket having a layer of fibrous insulating material adhered to its interior side surface. Air to be heated and/or cooled is flowed through this interiorly insulated cabinet structure, and across heat exchange apparatus disposed therein, on its way to the conditioned space served by the air conditioning equipment.

While this interiorly insulated cabinet construction is widely accepted and utilized in the modern day heating, ventilation and air conditioning industry, it is subject to various well known problems, limitations and disadvantages. For example, a considerable amount of time and expense is typically involved in cutting the fibrous insulating material (usually in sheet form) to size and adhesively adhering it to the interior side surface of the outer metal jacket portion of the cabinet. Additionally, the inner side surface of the installed fibrous insulation is directly exposed to the air flow internally traversing the cabinet. Bits and pieces of the insulation are thus susceptible to being dislodged and undesirably entrained in the air flow. The exposed placement of the fibrous insulation on the interior surface of the cabinet also increases the resistance to air flow through the cabinet, thereby correspondingly increasing the air-moving power requirement for the furnace. Further, the cabinet wall structure (particularly in larger cabinet sizes) tends to be undesirably flexible and often must be braced in some manner, thereby further adding to the overall fabrication cost associated with the air conditioning equipment.

As an alternative to this single wall cabinet construction, various double-walled cabinet structures have been previously proposed, as exemplified in U.S. Pat. No. 1,195,845 to Neal; U.S. Pat. No. 1,768,584 to Eaglesfield; U.S. Pat. No. 2,324,710 to Livar; and U.S. Pat. No. 2,527,226 to Levine. Each of these patents illustrates and describes a furnace housing having an outer wall structure defined by spaced apart inner and outer metal layers forming therebetween an insulating air space, with the interior side surface of the housing being devoid of insulating material. Accordingly, air flowing through the housing does so along a smooth metal surface, thereby eliminating the potential for entraining fibrous insulation material into the air flow.

While the absence of interior side surface insulation material exposed to air flow through these previously proposed furnace housing structures potentially provides them with a significant operating advantage over their interiorly insulated single wall counterparts, they have significant offsetting disadvantages that have rendered them generally unsuitable for modern day furnace construction. Specifically, each of the four depicted furnace housings is formed from separate double-walled panel sections which must be operatively intersecured using specially designed clip structures and/or fastening members.

For example, the cylindrical furnace housing depicted in U.S. Pat. No. 1,195,845 to Neal is formed from six separate wall sections provided along opposite edges thereof with clip structures which must be secured to adjacent clip structures on other wall sections with a multiplicity of threaded fasteners. Likewise, the rectangular furnace housing shown in U.S. Pat. No. 2,324,710 to Livar is formed from four separate double-walled panel structures joined at their adjacent side edges by interlockable clip structures.

Another problem associated with double-walled cabinet structures of conventional construction is the relative complexity of each of their separate double-walled panel sections. For example, each of the four separate housing wall sections shown in the Livar patent comprises inner and outer metal panels to which a series of metal clip members and spacing members must be individually welded before the housing can be assembled. This structural complexity associated with the individual double-walled panel structures, coupled with the complexity and time associated with intersecuring them to form the overall cabinet structure, has heretofore rendered the use of double-walled cabinet structures in air conditioning application generally unsuitable from an economic standpoint.

It can be readily seen from the foregoing that it would be desirable to provide a double-walled air conditioning equipment cabinet structure which eliminates, or at least substantially reduces, the above-mentioned problems, limitations and disadvantages heretofore associated with conventionally configurated cabinetry of both single and double-walled construction. It is accordingly an object of the present invention to provide such a cabinet structure.

SUMMARY OF THE INVENTION

In carrying out principles of the present invention in accordance with a preferred embodiment thereof, the blower and heat exchanger components of an air conditioning unit are housed within a specially designed, double-walled sheet metal cabinet structure representatively comprising a rectangularly cross-sectioned coil housing secured to the outlet end of a rectangularly cross-sectioned return housing.

According to a feature of the invention, each housing is constructed by positioning essentially flat inner and outer bendable rectangular wall panels in an aligned laterally facing relationship; transversely bending opposite end portions of the panels, relative to central portions thereof, to form a generally U-shaped structure defining three side walls of the housing and having an open side opposite the central portion of the inner wall panel; interconnecting outer ends of the outer wall panel to hold it in its transversely bent configuration; providing a double-walled access panel; and removably securing the access panel to the U-shaped structure, across the open side thereof, to form the fourth side wall of the rectangular housing.

Cooperating abutment means are formed on the inner and outer panels from integral portions thereof. With the panels in their transversely bent, nested orientation, the cooperating abutment means function to captively retain the inner panel on the outer panel, without using supplemental fastening means, and also function to space the panels apart in a manner maintaining a generally U-shaped insulating air space between the nested panels.

The double-walled cabinet structure formed in this manner permits the elimination of the usual fibrous insulation conventionally adhered to the interior side surface of an air conditioning equipment cabinet structure, the insulation of the stacked coil and return housings being achieved instead by the dead air space disposed between their spaced apart inner and outer side walls. Air sequentially flowing through the two housings does so along their smooth, insulationless inner side surfaces, thereby decreasing the air flow resistance associated with the housings and eliminating the possibility of fibrous insulation material entrainment in the air flow.

In a preferred embodiment thereof, the aforementioned cooperating abutment means on each of the two housings include transversely bent opposite end and side edge portions on the inner and outer panels, and generally V-shaped troughs formed on the inner panel and longitudinally extending transversely to its opposite side edges. When the initially flat inner and outer panels are placed in their aligned relationship prior to transverse bending thereof, the bent opposite end and side edge portions of the inner sheet metal panel are in an inwardly adjacent, facing relationship with the bent opposite end and side edge portions of the outer sheet metal panel, and the V-shaped trough portions on the inner panel project toward and engage the inner side surface of the outer panel. When the aligned panels are transversely bent, the bending occurs along the lengths of the troughs, and the bent opposite end and side edge portions of the outer panel act as abutment stops which captively retain the inner panel on the outer panel.

According to another feature of the present invention, the outer ends of the transversely bent, generally U-shaped outer panel on each housing are secured to the opposite ends of an elongated connecting member having a flat portion which overlies a side edge portion of the outer panel. An inner side section of this flat portion, together with inner side sections of the bent portions of the outer panel extending along this side edge thereof, may be laterally outwardly bent to collectively define a generally rectangular external duct connection flange on the housing.

BRIEF DESCRIPTION OF THE DRAWINGS

FIG. 4 is a perspective view of the panel members operatively interfitted prior to transverse bending thereof to form the aforementioned three side walls of the coil housing;

FIG. 5 is a cross-sectional view through the interfitted panel members taken along line 5—5 of FIG. 4;

FIG. 6 is a vertically foreshortened, enlarged scale fragmentary cross-sectional view through the coil housing taken along line 6—6 of FIG. 2; and FIG. 7 is a vertically foreshortened, enlarged scale cross-sectional view through a double-walled access door portion of the coil housing taken along line 7—7 of FIG. 2.

DETAILED DESCRIPTION

Figure 1:
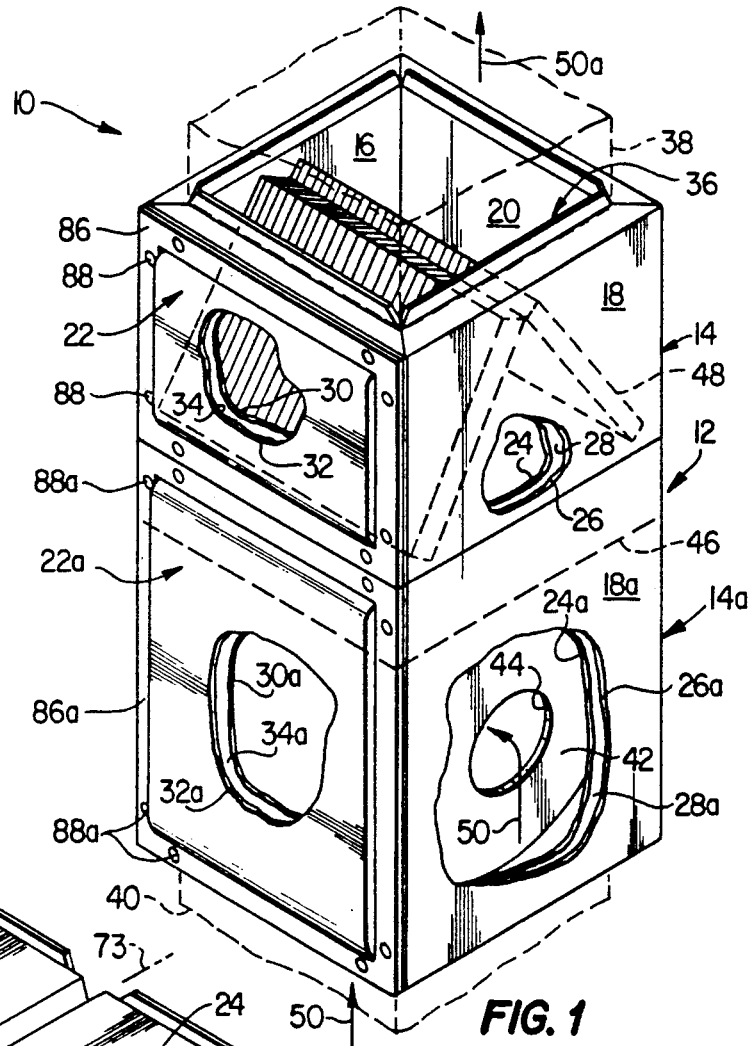
FIG. 1 is a partially cut away perspective view of a representative up-flow forced air furnace incorporating therein a unique double-walled cabinet structure which embodies principles of the present invention.

The air conditioning equipment perspectively illustrated in FIG. 1 is representatively in the form of a forced air furnace 10 which is provided with a rectangularly cross-sectioned double-walled cabinet structure 12 which embodies principles of the present invention. Cabinet structure 12 comprises a rectangularly cross-sectioned upper coil housing 14 having open upper and lower ends and secured atop a somewhat taller return housing $\mathbf{14}_a$ which also has a rectangular cross-section, and open upper and lower ends. The coil housing 14 has left, right and rear side wall sections 16, 18 and 20, and an open front side which is covered by a removable access panel structure 22.

Figure 2:
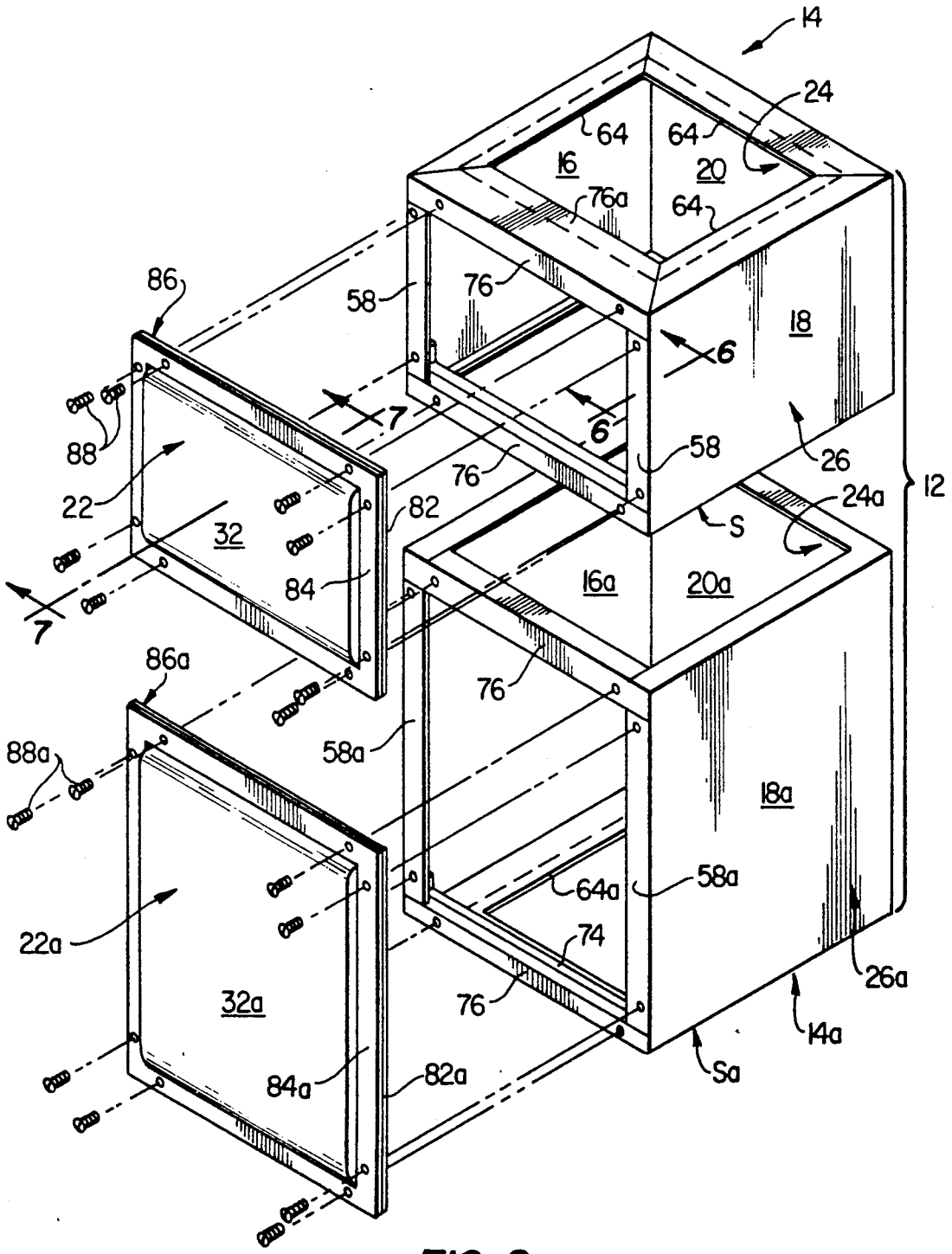
FIG. 2 is an exploded perspective view of the cabinet structure.

Referring now to FIGS. 1 and 2, each of the side wall sections 16, 18 and 20 of the coil housing 14 is of a double-walled construction defined by horizontally spaced apart inner and outer sheet metal walls 24, 26 defining therebetween an insulating air space 28. The access panel 22 is also of a double-walled construction (see FIGS. and 7) defined by horizontally spaced apart inner and outer sheet metal walls 30 and 32 which define therebetween an insulating air space 34.

In a similar manner, the return housing $\mathbf{14}_a$ has left, right and rear side wall sections $\mathbf{16}_a$, $\mathbf{18}_a$, and $\mathbf{20}_a$ and has removably secured to its open front side an access panel $\mathbf{22}_a$. The side wall sections $\mathbf{16}_a$, $\mathbf{18}_a$ and $\mathbf{20}_a$ are each of a double-walled construction formed by horizontally spaced apart inner and outer sheet metal walls $\mathbf{24}_a$, $\mathbf{26}_a$ which define therebetween an insulating air space $\mathbf{28}_a$. The access panel $\mathbf{22}_a$ is also of a double-walled construction, having inner and outer sheet metal walls $\mathbf{30}_a$, $\mathbf{32}_a$ which define therebetween an insulating air space $\mathbf{34}_a$.

As illustrated in FIG. 1, the open upper end of the coil housing 14 is provided around its periphery with an upturned generally rectangular duct connection flange 36 to which a supply duct 38, shown in phantom, is operatively connected. In a similar fashion, the open lower end of the return housing $\mathbf{14}_a$ is provided around its periphery with a downwardly projecting, generally rectangular duct connection flange (not shown) to which a return duct 40, shown in phantom, is operatively connected.

A supply air blower 42, having an inlet opening 44 is disposed within the return housing $\mathbf{14}_a$, as is a schematically depicted heat exchange structure 46, such as an electric resistance heating coil or a hot combustion gas heat exchanger. A heat exchange structure, such as a refrigerant coil 48, is operatively supported within the coil housing 14.

During operation of the furnace 10, which is representatively illustrated in an up-flow orientation, return air 50 from the conditioned space served by the furnace is drawn upwardly through the duct 40, into the inlet 44 of the blower 42, forced upwardly across the heat exchange structures 46 and 48, and returned to the conditioned space, as conditioned air $\mathbf{50}_a$, via the supply duct 38. The air vertically traversing the interior of the cabinet structure 12 does so along smooth metal interior surfaces thereof since, unlike conventionally constructed air conditioning equipment cabinet structures, the cabinet 12 does not have fibrous insulation material adhered to its interior side surface. The thermal insulation of the cabinet 12 is accomplished instead by the various aforementioned insulating spaces disposed between the inner and outer walls of the housing 14 and 14$_a$.

Each of the double-walled housings 14, 14$_a$ may be rapidly and relatively inexpensively constructed using a unique method of the present invention which will now be described in conjunction with FIGS. 3–6. This construction method is the same for eaoh of the illustrated housings 14, 14$_a$. Accordingly, the following description representatively relates to the construction of the upper coil housing 14. However, it will be readily appreciated that the lower housing 14$_a$ is constructed using the same steps.

Figure 3:
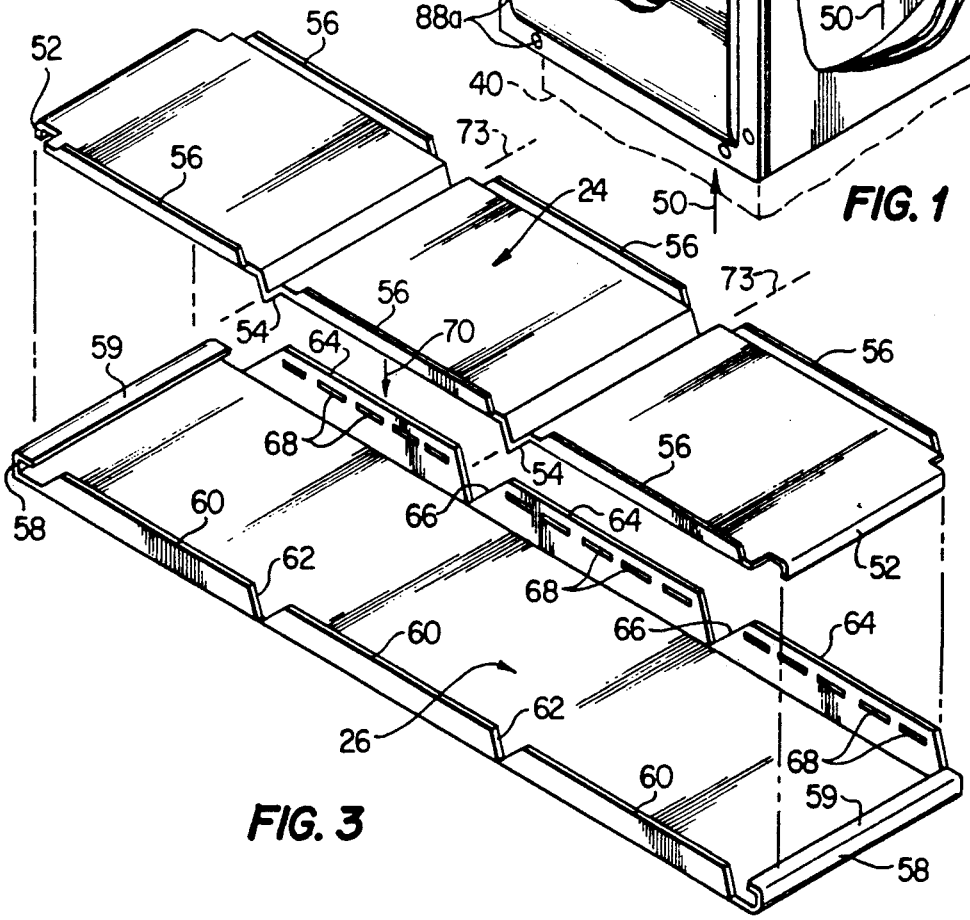
FIG. 3 is a perspective view of elongated rectangular inner and outer sheet metal panel members used to form three side walls of a coil housing portion of the cabinet structure.

Referring now to FIG. 3, the upper coil housing 14 is formed from essentially flat, elongated rectangular sheet metal inner and outer wall panel members 24 and 26. The inner wall panel member 24 has downturned opposite end edge portions 52 and longitudinally spaced apart, generally V-shaped downwardly projecting troughs 54 which longitudinally extend in directions parallel to the downturned end edges 52. Positioned between the downturned end edges 52 and the troughs 54, along opposite sides of the panel 24, are upturned side edge portions 56. The outer wall panel member 26 has upturned opposite end edge portions 58 with inturned lip portions 59 and, along its near side edge, three upturned side edge portions 60 separated by a pair of generally V-shaped notches 62. Extending along the far side of the outer panel 26 are three upturned side edge portions 64 separated by a pair of generally V-shaped notches 66 which are longitudinally aligned with the previously mentioned pair of notches 62. The upturned side edge portions 64, as illustrated, are vertically wider than the upturned side edge portions 60 and, for reasons subsequently discussed, have formed along their lengths a series of horizontally elongated slots 68.

In forming the upper coil housing 14, the inner wall panel member 24 is positioned above the outer wall panel 26, in alignment therewith and is then moved downwardly, as indicated by the arrow 70 in FIG. 3, into a laterally nested relationship with the outer wall panel 26 as depicted in FIGS. 4 and 5. In this laterally nested relationship, the upturned end flanges 58 of the outer wall panel 26 outwardly overlie the downturned end edges 52 of the inner wall panel, and the upturned side edge portions 60 and 64 of the outer panel 26 outwardly overlie the upturned side edge portions 56 of the inner wall panel member 24, with the downturned end portions 52 and the V-shaped troughs 54 of the inner wall panel member 24 engaging the inner side surface of the outer wall panel member 26. As will be readily apparent to those skilled in the sheet metal fabrication art, to facilitate the nesting of the inner wall panel 24 within the outer wall pane 26 the opposite end sections of panel 24 are bent slightly downwardly as panel 24 is moved toward panel 26. This permits the downturned ends 52 of panel 24 to inwardly clear the inturned lip portions 59 of panel 26. When the ends 52 clear the lip portions 59, the panel 24 is simply straightened to bring it into its nested relationship with panel 26 as shown in FIGS. 4 and 5. The engagement of the downturned end edge portions 52 and the lower edges of the troughs 54 with the inner side surface of the outer wall panel 26 vertically separate the panels 24, 26 and create therebetween the insulating air spaces 28 as illustrated in FIG. 5.

Opposite end portions of the laterally nested panels 24, 26 are then bent upwardly (as indicated by the arrows 72 in FIGS. 4 and 5), relative to a central portion of the panels disposed between the troughs 54, until the outer end portions of the panels are transverse to their central portions. The upward bending of the opposite outer end portions of the nested panels occurs along transverse bend lines 73 longitudinally extending through the V-shaped troughs 54, the proper positioning of these two bend lines 73 being facilitated by the engagement of the lower longitudinal edges of the troughs 54 with the inner side surface of the outer wall panel member 26.

With the panels 24, 26 transversely bent in this manner, they form a generally U-shaped structure S (FIG. 2) in which the generally U-shaped inner wall panel member 24 is nested within the correspondingly configurated outer wall panel member 26, the three sides of the structure S defining the previously mentioned left, right and rear side wall sections 16, 18 and 20 of the upper coil housing 14. As illustrated in FIGS. 2 and 6, the inner and outer panels 24, 26 are held in their U-shaped transversely bent configurations by inner elongated metal connecting members 74 having U-shaped cross sections along their lengths, and outer elongated metal connecting members 76 having generally J-shaped cross sections along their lengths, the inner members 74 being nested within their associated outer members 76 as shown. The nested connecting members 74, 76 have angled, overlapping tabs 75, 77 at their outer ends which are secured to the upper and lower corners of the open front side of the structure S by sheet metal screws 78. The nested connecting member pairs 74,76 connected at their opposite ends to the left ends of the generally U-shaped structure 5 (FIG. 2) thus function as bracing structures which securely hold the structure S in its U-shaped configuration. The top connecting member 76 has a top side portion 76$_a$ which, together with inner side portions of the transversely bent side edge sections 64 of the outer wall panel member 26, may be upwardly bent to form the previously mentioned external duct connection flange 36 (FIG. 1) to which the supply duct 38 may be connected.

According to an important feature of the present invention, with the inner and outer wall panel members held in their transversely bent configurations by the connecting members 74 and 76, the previously mentioned transversely bent panel portions 52, 56, 58, 59, 60 and 64, and the V-shaped troughs 54, function as cooperating abutment means which captively retain the inner wall panel member 24 on the outer wall panel member 26, and also serve to maintain the previously mentioned insulation spaces 28 between the inner and outer wall panel members.

As can be seen by comparing FIGS. 2 and 6, the inturned end edge portions 58 of the outer wall panel 26 act as stops for the inturned end edge portions 52 of the inner wall panel to prevent the inner wall panel 24 from moving leftwardly relative to the outer wall panel, while the inturned side edge portions 60 and 64 of the outer panel act as stops for the outwardly bent side edge portions 56 of the inner panel to prevent the inner panel from moving upwardly or downwardly relative to the outer panel. Additionally, as previously mentioned, the inturned end edge portions 52 of the inner panel, together with the troughs 54, act as spacing portions within the transversely bent panels to maintain the insulating air spaces 28 therebetween.

Referring now to FIGS. 2 and 7, the inner and outer sheet metal walls 30, 32 of the access panel 22 are of a drawn construction, with central portions of the walls being outwardly formed relative to peripheral portions 82, 84 thereof which are suitably intersecured and define a connection flange 86 around the periphery of the access panel structure. The access panel 22 is removably secured over the open front end of the three-sided structure S by means of a series of sheet metal screws 88 extended through suitable openings in flange 86 as illustrated in FIG. 2.

As previously mentioned, the return housing $\mathbf{14}_a$ is constructed in the same manner as just described in conjunction with the coil housing 14, with components in the return housing $\mathbf{14}_a$ similar to those in housing 14 being given identical reference numerals, but with the subscript "a", for ease in comparison to their counterparts in housing 14. It can be seen in FIGS. 1 and 2 that the housing $\mathbf{14}_a$ is formed from transversely bent, interlocked inner and outer sheet metal wall panel members $\mathbf{24}_a$ and $\mathbf{26}_a$, which form the three-sided housing structure $S_a$, with these panel members being held in their transversely bent, nested configuration by the elongated connection members 74, 76 respectively extending between the top and bottom corners of the open front side of the structure $S_a$. The double-walled access panel structure $\mathbf{22}_a$ is removably secured over the open front side of the structure $S_a$ by means of sheet metal screws $\mathbf{88}_a$.

As in the case of the access panel 22, the walls $\mathbf{30}_a$, $\mathbf{32}_a$ of the access panel $\mathbf{22}_a$ form an insulating air space $\mathbf{34}_a$ therebetween (FIG. 1), and the inner and outer panels $\mathbf{24}_a$, $\mathbf{26}_a$ which form the three interconnected housing side wall sections $\mathbf{16}_a$, $\mathbf{18}_a$ and $\mathbf{20}_a$ define insulating air spaces $\mathbf{28}_a$ therebetween. On the bottom end of the housing $\mathbf{14}_a$, horizontally inner side portions of the inwardly bent side edge sections $\mathbf{64}_a$ and the connecting member $\mathbf{76}_a$ may be downwardly bent to form the previously mentioned generally rectangular duct connection flange to which the return duct 40 (FIG. 1) may be secured.

It can be readily seen from the foregoing that the housings 14, $\mathbf{14}_a$ may be easily and quite rapidly formed without the necessity of individually constructing each of their four side walls and then individually interconnecting all of the four side walls with threaded fasteners or specially designed clip members, as is the case in double-walled air conditioning cabinet apparatus of conventional construction. As described above, three of the four side walls of each of the housings 14, $\mathbf{14}_a$ are formed from only two elements - the initially flat sheet metal panels 24, 26 (or $\mathbf{24}_a$, $\mathbf{26}_a$ as the case may be) which are captively interlocked to one another by their integral cooperating abutment means that also automatically function to create and maintain the insulating air spaces between the bent panels.

Together with the simple access panel structures 22 and $\mathbf{22}_a$, this permits the overall cabinet structure 12 to be very economically formed to provide the benefit of a double-walled construction (i.e., the ability to eliminate the presence of a fibrous insulation material on its interior surface) without the attendant labor costs heretofore associated therewith.

It will be readily apparent to those skilled in this particular art that this unique housing construction method can be employed in conjunction with a variety of air conditioning equipment including furnaces, air handlers, and heat lumps, of both vertical and horizontal air flow configurations, and heating and/or cooling coils.

The foregoing detailed description is to be clearly understood as being given by way of illustration and example only, the spirit and scope of the present invention being limited solely by the appended claims.

What is claimed is:

1. A method of constructing a double-walled rectangularly cross-sectioned air conditioning apparatus housing, said method comprising the steps of:

positioning generally flat inner and outer bendable rectangular wall panels in an aligned, laterally facing relationship;

transversely bending opposite end portions of the aligned, laterally facing inner and outer wall panels, relative to central portions thereof, thereby forming a generally U-shaped structure in which the transversely bent inner wall panel is nested within the transversely bent outer wall panel, the U-shaped structure having outer end portions and defining three connected side walls of the housing and having an open side opposite a central portion of the inner wall panel;

connecting at least one bracing structure to and between said outer end portions of the U-shaped structure, thereby holding it in its generally U-shaped configuration; and utilizing integral portions of the transversely bent inner and outer wall portions to captively hold the inner wall panel on the outer wall panel, and to maintain a generally U-shaped insulating air space between the transversely bent inner and outer wall panels.

2. The method of claim 1 further comprising the steps of:

providing a double-walled access panel, and removably securing said access panel to said U-shaped structure over said open side thereof.

3. A method of constructing an air conditioning equipment cabinet, said method comprising the steps of:

positioning generally flat, bendable rectangular outer side wall panel member having inner and outer side surfaces, opposite end edge portions, and opposite side edge portions;

forming firs abutment means on said outer side wall panel member from integral portions thereof;

providing a generally flat, bendable rectangular inner side wall panel member having inner and outer side surfaces, opposite end edge portions, and opposite side edge portions;

forming second abutment means on said inner side wall panel member from integral portions thereof;

positioning said outer and inner side wall panel member in a generally aligned, inner side-to-inner side facing relationship with said opposite end edge portions of said inner side wall panel member being inwardly adjacent said opposite end edge portions of said outer side wall panel member, and said opposite side edge portions of said inner side wall panel member being inwardly adjacent said opposite side edge portions of said outer side wall panel member;

transversely bending outer end portions of said outer and inner side wall panel members, relative to central portions thereof, thereby forming a generally U-shaped structure in which the transversely bent inner side wall panel member is nested within the transversely bent outer side wall panel member; and holding said outer side wall panel member in its transversely bent orientation, said first abutment means outwardly overlying and engaging said second abutment means and cooperating therewith to captively retain the nested inner side wall panel member within the transversely bent outer side wall panel member and to maintain a generally U-shaped insulating air space between said outer and inner side wall panel members.

4. The method of claim 3 wherein:

said generally U-shaped structure has an open side positioned opposite the central portion of said inner side wall panel member, and said method further comprises the steps of providing a double-walled access panel having an insulation space disposed between outer and inner wall portions thereof, and removably securing said access panel to said generally U-shaped structure over said open side thereof.

5. The method of claim 3 wherein:

said step of forming first abutment means is performed by inwardly bending opposite end edge portions and opposite side edge portions of the generally flat outer side wall panel member, and said step of forming second abutment means is performed by inwardly bending opposite end edge portions of the generally flat inner side wall panel member, outwardly bending opposite side edge portions of the generally flat inner side wall panel member, and forming a spaced apart pair of generally V-shaped troughs in the generally flat inner side wall panel member which longitudinally extend transversely to its opposite side edges and laterally project from its inner side surface.

6. The method of claim 3 wherein:

said step of forming first abutment means includes the step of inwardly bending spaced apart sections of said side edge portions of the generally flat outer side wall panel member thereby forming abutment tabs;

said step of holding said outer side wall panel member in its transversely bent orientation includes the step of securing opposite ends of an elongated connecting member to outer end portions of said generally U-shaped structure, and said method further comprises the step of laterally bending said abutment tabs and said connecting member thereby forming therefrom a generally rectangular, outwardly projecting duct connection flange on said cabinet.

* * * * *

UNITED STATES PATENT AND TRADEMARK OFFICE

CERTIFICATE OF CORRECTION

PATENT NO. : 5,170,550

DATED : December 15, 1992

INVENTOR(S) : Jimmy L. Cox, et al.

It is certified that error appears in the above-identified patent and that said Letters Patent is hereby corrected as shown below:

Column 4, line 26, insert --1-- after the word "FIGS.".

Column 5, line 9, "eaoh" should read --each--.

Column 5, line 56, "pane" should read --panel--.

Column 8, line 42, "positioning" should be --providing a--.

Signed and Sealed this

Twelfth Day of April, 1994

Bruce Lehman

BRUCE LEHMAN

*Commissioner of Patents and Trademarks*

*Attest:*

*Attesting Officer*